US011206907B2

(12) United States Patent
Korb et al.

(10) Patent No.: US 11,206,907 B2
(45) Date of Patent: Dec. 28, 2021

(54) HOLDING STRUCTURE FOR BAG POCKET SYSTEM

(71) Applicant: adidas AG, Herzogenaurach (DE)

(72) Inventors: Christine Korb, Neustadt/Aisch (DE); Sonja Ziegler, Nuremberg (DE)

(73) Assignee: adidas AG, Herzogenaurach (DE)

( * ) Notice: Subject to any disclaimer, the term of this patent is extended or adjusted under 35 U.S.C. 154(b) by 195 days.

(21) Appl. No.: 16/555,740

(22) Filed: Aug. 29, 2019

(65) Prior Publication Data

US 2020/0069020 A1 Mar. 5, 2020

(30) Foreign Application Priority Data

Sep. 3, 2018 (DE) ..... 102018214910.0

(51) Int. Cl.

*A45C 13/30* (2006.01)
*A45F 3/04* (2006.01)
*A45F 3/00* (2006.01)

(52) U.S. Cl.

CPC ..... *A45C 13/30* (2013.01); *A45F 3/04* (2013.01); *A45C 2013/306* (2013.01); *A45F 2003/003* (2013.01)

(58) Field of Classification Search

CPC ..... A45C 13/30; A45C 2013/306; A45F 3/04; A45F 2003/003; A45F 5/02; A45F 5/022
See application file for complete search history.

(56) References Cited

U.S. PATENT DOCUMENTS 8,608,041 B1 12/2013 Adkisson
9,854,897 B1 1/2018 Pelkey, Jr. et al.
2005/0252119 A1 11/2005 Funk-Danielson
2009/0039122 A1 2/2009 Antonioni
2013/0068919 A1 3/2013 Antonioni
2014/0252786 A1 9/2014 Singhal
2016/0230929 A9 8/2016 Singhal

FOREIGN PATENT DOCUMENTS

| | | |
|---|---|---|
| CN | 107136736 | 9/2017 |
| JP | S58147566 | 10/1983 |
| JP | S63127422 | 8/1988 |
| JP | 2007195873 | 8/2007 |
| JP | 2014024461 | 2/2014 |
| JP | 6047326 | 11/2016 |
| WO | 2005112677 | 12/2005 |

OTHER PUBLICATIONS

European Application No. 19195108.6, "Extended European Search Report" dated Dec. 13, 2019, 8 pages.
Chinese Application No. 201910821663.2, Office Action dated Dec. 28, 2020, 15 pages (English machine translation provided).
German Patent Application No. 102018214910.0 Office Action dated Jul. 30, 2019, 12 pages (includes machine English translation).
Japanese Patent Application No. 2019142944, Office Action, dated Oct. 20, 2020, 6 pages (English machine translation provided).
Chinese Patent Application No. 201910821663.2, Office Action dated Aug. 11, 2021, 4 pages (English machine translation submitted.

*Primary Examiner* — Corey N Skurdal
(74) *Attorney, Agent, or Firm* — Kilpatrick Townsend & Stockton LLP

(57) ABSTRACT

Described is a holding structure for a bag. The holding structure comprises a first band and a second band arranged on a panel of the bag, each of the first band and the second band comprising an elastic material. The first band and the second band define an angle greater than 0° and less than 90° with a partial overlap so that two at least partially superimposed holding regions are formed.

18 Claims, 6 Drawing Sheets

HOLDING STRUCTURE FOR BAG POCKET SYSTEM

CROSS REFERENCE TO RELATED APPLICATION

This application is related to and claims priority benefits from German Patent Application No. DE 10 2018 214 910.0, filed on Sep. 3, 2018, entitled HOLDING STRUCTURE ("the '910.0 application"). The '910.0 application is hereby incorporated herein in its entirety by this reference.

FIELD OF THE INVENTION

The present invention relates to a holding structure for a bag, and to a bag comprising such a holding structure.

BACKGROUND

Bags, such as backpacks, duffle bags, suitcases or similar, typically comprise at least one large compartment for holding items. Such bags may also comprise at least one smaller compartment intended to hold smaller items to keep them safe and separate from the items in the large compartment of the bag. Smaller compartments are provided with specific sizes, shapes and positions to suit the items they are intended to hold—for example pen holders and drinks bottle holders are both cylindrical compartments, but of different sizes. Smaller compartments may be on the inside or outside of a bag.

The smaller compartments or pouches may be made from the same material as the large compartment of the bag, such as a textile material or any other suitable material. Alternatively, the smaller compartments or pouches may be made from a different material than the large compartment of the bag, such as a mesh or strap. A mesh may be lighter than other materials, or a strap may be stronger than other materials.

A disadvantage of known pouches for bags is that they are typically formed as individual pouches. When storing items within a plurality of separate pouches, a significant amount of the available space within or on the outside of a bag is taken up. As a result, only a limited number of pouches may be provided which leads in turn to limited possibilities for separately storing a greater number of items.

It is known to provide straps rather than pouches for retaining items on or within a bag. Straps take up less space than full pouches and usually require less additional material to construct. A strap may retain an object between a strap and a surface of the bag. Straps may be elastic or adjustable if desired.

A better organization may be achieved with bags comprising multiple straps, as for example in bags offered under the trade name Grid-it®. A similar arrangement of multiple straps is disclosed in US 2009/0039122 A1. However, attaching items by means of a plurality of parallel and perpendicular straps may not be sufficient to reliably secure the items and to prevent them from slipping out. Thus, pouches and straps as known cannot reliably avoid items from becoming disorganized or even lost.

It is therefore an object of the present invention to provide a holding structure for bags, which at least partly overcomes the above outlined disadvantages and facilitates the flexible and reliable storage of a plurality of items in a reduced space.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various embodiments of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

According to certain embodiments of the present invention, a holding structure for a bag, the holding structure comprises a first band and a second band arranged on a panel of the bag, each of the first band and the second band comprising an elastic material; wherein the first band and the second band define an angle greater than 0° and less than 90° with a partial overlap of the first band and the second band so that at least two partially superimposed holding regions are formed.

In some embodiments, the holding structure further comprises a third band arranged on the panel of the bag and comprising an elastic material, wherein the third band overlaps at least partially with at least one of the first band or the second band so that a third holding region is formed, and wherein the third band is parallel to the first band.

In certain embodiments, the holding structure further comprises a fourth band arranged on the panel of the bag and comprising an elastic material, wherein the first band is parallel to the third band, and the second band is parallel to the fourth band.

In some embodiments, the holding structure further comprises more than four overlapping bands.

The holding structure, in certain embodiments, comprises at least four bands, wherein the second band extends over the third band and below the first band, and wherein the third band extends over the fourth band and below the second band.

In some embodiments, at least one holding region forms a pouch.

An outermost band of the holding structure, in certain embodiments, is sealed along one outermost edge to form a pouch.

A lining, in some embodiments, is arranged between at least one band and the panel of the bag to form a pouch.

The sealed outermost band, in certain embodiments, is a base band, wherein the base band is wider than at least one other band of the holding structure.

In some embodiments, at least one band which is arranged in parallel on the panel of the bag comprises a lining arranged between the at least one band and the panel of the bag to form at least one pouch.

In certain embodiments, at least one band which is arranged in parallel on the panel of the bag is sealed along a same side such as to form at least one pouch.

In some embodiments, at least one band which is arranged in parallel on the panel of the bag comprises a lining arranged thereon, wherein the lining extends to a base band such as to form at least one pouch of a different size.

In certain embodiments, the holding structure further comprises a reinforcing layer arranged on the bag, wherein the reinforcing layer is arranged between the panel and at least one band.

A width of at least one band, in some embodiments, is between 1 cm and 30 cm.

A length of at least one band, in certain embodiments, is between 1 cm and 45 cm.

A length of the holding structure, in some embodiments, is between 5 cm and 45 cm, and wherein a height of the holding structure is between 5 cm and 30 cm.

In certain embodiments, at least one band extends substantially from one lateral edge of the panel of the bag to the other lateral edge of the panel of the bag.

In some embodiments, the holding structure is arranged on an outside of the bag.

In certain embodiments, the bag comprises the holding structure.

The bag, in some embodiments, comprises a backpack and wherein the holding structure is arranged on a rear side of the backpack.

BRIEF DESCRIPTION OF THE DRAWINGS

In the following detailed description, embodiments of the invention are described referring to the following figures.

BRIEF DESCRIPTION

Figure 1:
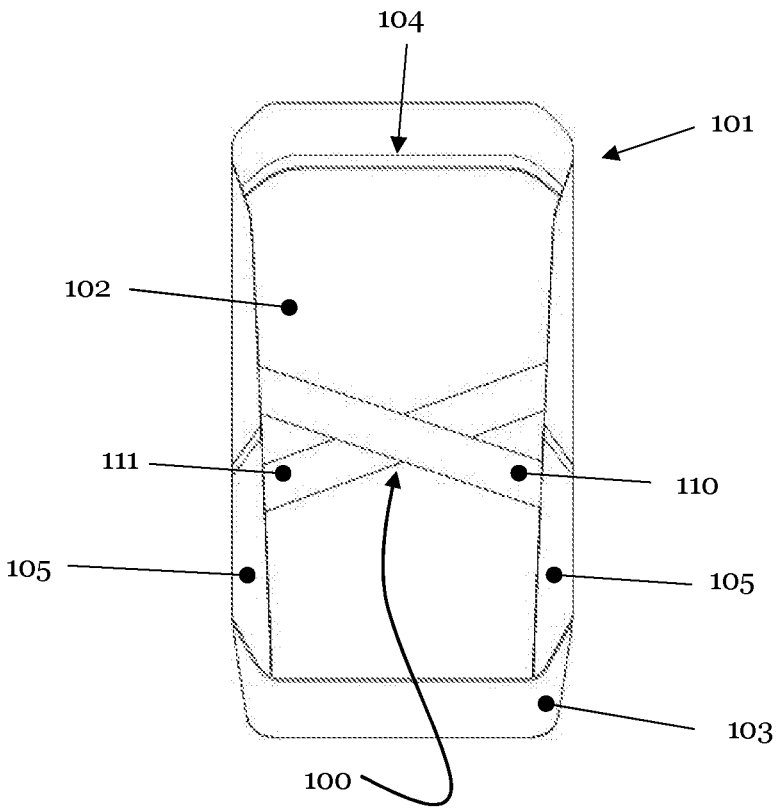
FIG. 1 is a front view of a holding structure comprising two overlapping bands arranged on a rear side of a backpack according to certain embodiments of the present invention.

The above object is at least partially achieved by a holding structure for a bag according to claim 1.

In some embodiments, the holding structure comprises a first band and a second band arranged on a panel of the bag, each of the first band and the second band comprising an elastic material, wherein the first band and the second band define an angle greater than 0° and less than 90° with a partial overlap so that two at least partially superimposed holding regions are formed. In some embodiments, the first band and the second band define an angle greater than 0° and less than 90° with a partial overlap, and the first band extends over the second band.

The overlapping first and second bands may form an oblique and an acute angle at the overlap. Therein, the arrangement of the first and second bands may be diagonal, crosswise, slanted, sloped, or in any other similar way such that an oblique and an acute angle may be created at the overlap.

Due to the overlapping arrangement of the bands such that an angle greater than 0° and less than 90° is formed, the corresponding holding structure is arranged in a compact manner but still provides different holding regions. The holding regions may be formed between the bands and/or between each band and the panel of the bag. Thus, the holding structure facilitates an organized storage of various items. Moreover, the overlapping arrangement of the bands improves their stability against an excessive stretching, which in turn improves the capabilities of the corresponding holding regions to reliably store items of significant size and weight.

The holding structure may include a third band comprising an elastic material arranged on the panel of the bag, wherein the third band may overlap at least partially with at least one of the first band and the second band. In some embodiments, the third band may be arranged over the second band. The third band may further be parallel to the first band, and it may form a third holding region. In this context, parallel is to be understood as "essentially parallel", wherein the term "essentially" is understood to encompass regular production deviations as they are known to the skilled person. With the third band, not only are more holding regions provided, they are also arranged in a very space-saving manner. Additionally, the overlap between the third band and the at least one other band further increases the stability of the plurality of holding regions. This stability is created because the force by which items are pressed against the panel is increased allowing even heavier items to be stored in the respective holding region.

The holding structure may include a fourth band comprising an elastic material arranged on the panel of the bag, wherein the first band may be arranged essentially parallel to the third band, and the second band may be arranged essentially parallel to the fourth band. Thereby, a very compact arrangement of the plurality of superimposed holding regions, and thus the holding structure, is provided.

Still further, the holding structure may comprise more than four overlapping bands. Thereby, not only are more superimposed holding regions provided due to the overlapping bands, but the stability of the plurality of holding regions is also increased.

The holding structure may comprise at least four bands. The bands may be arranged such that the second band may extend over the third band and below the first band, and the third band may extend over the fourth band and below the second band. Thereby, a particularly stable webbing structure may be provided. Such a webbing structure may provide a firm attachment of items stored within the holding regions. The likelihood of items slipping out of the holding regions and getting lost is even further reduced.

Further, at least one of the holding regions may be provided as a pouch. A holding region may be provided as a pouch, e.g., by sealing a band along one long edge. This may be achieved by sealing the band along a bottom edge when the holding structure is oriented along a vertical direction of a bag such as a backpack. Alternatively, this may be achieved by sealing the band along a right- or left-hand side when the holding structure is oriented along a horizontal direction, such as on a duffel bag. Sealing the band along the bottom edge may be achieved by stitching, gluing or otherwise connecting the bottom edge of the corresponding band to the panel of the bag. These arrangements provide pouches with the same depth as the width of the bands.

In some examples, the holding structure may comprise an outermost band which may be sealed along one outermost edge to form a pouch. The outermost band may be the band which extends over the at least one other band. The outermost band may be the first band or it may be any other band extending over the first band. For such a configuration, items are retained between the band and the panel, or between a band and an underlying band, either by the recovery force of a displaced elastic band, or by tightening a non-elastic band.

Alternatively, a holding region may also be provided as a pouch by attaching a lining to the band. The lining may be a light and flexible material. The lining may be attached to a face of at least one band adjacent the panel of the bag. Alternatively, the lining may be attached to a long edge of at least one band. The lining may be attached by sealing a bottom edge of the lining to the panel of the bag. Alternatively, the lining may be folded over on itself and attached by sealing a top edge of the lining to the panel of the bag at the same height as the band from which the lining extends. The lining may be sealed by stitching, gluing or otherwise connecting an edge of the lining to the panel of the bag. In this configuration items are retained between the lining and the panel of the bag or are enveloped by the bag.

In some examples, more than one holding region may form a pouch. Due to the superimposed pouches, items stored within the pouches are particularly secured and they are prevented from slipping out. Alternatively, one holding region may form a pouch while another holding region may not form a pouch. Thereby, the holding region that does not form a pouch beneficially allows for securely holding larger items, which may not fit into the pouch formed by the one holding region. Alternatively, the holding region that does not form a pouch allows for attaching an item to the panel and—due to its overlap with the one holding region providing a pouch—to partly insert the item into this pouch. Thus, the flexibility of the storing options of the claimed holding structure is further increased.

The outermost band which may be sealed along one outermost edge may be a base band. The base band may be wider than the other bands of the holding structure. Therefore, the base band may form a pouch, which forms a stable base of the holding structure.

Still further, at least one band of the holding structure, which may be arranged essentially parallel on the panel of the bag, may comprise a lining arranged between each band and the panel of the bag. Thereby, at least one pouch may be formed. The pouches may be formed between the linings. In some examples, the pouches may have the same size, where the same is to be understood as "essentially the same", wherein the term "essentially" is understood to encompass regular production deviations as they are known to the skilled person. Alternatively, at least one band of the holding structure, which may be arranged essentially parallel on the panel of the bag, may be sealed along one side to form at least one pouch. In some embodiments, the pouches may be sealed along the same side, e.g. a bottom edge when the holding structure is oriented along a vertical direction of a bag such as a backpack or a right- or left-hand side when the holding structure is oriented along a horizontal direction, such as on a duffel bag. In some examples, the at least one pouch may be of essentially the same size. In some embodiments, the at least one pouch may be formed between the bands.

In certain embodiments, at least one band of the holding structure, which may be arranged essentially parallel on the panel of the bag, may comprise a lining arranged on the at least one band, wherein each lining may extend to a base band. Thereby, at least one pouch of a different size may be formed. Thereby, the pouches may be formed between the linings.

The holding structure may comprise a reinforcing layer arranged on the bag, wherein the reinforcing layer may be arranged between the panel and the bands. The reinforcing layer may further increase the stability of the holding structure. When the holding structure is more stable, the arrangement of an item in any of the holding regions may also be more stable. The reinforcing layer may provide additional friction, when the elastic bands press items held within the holding regions against this layer.

In some embodiments, a width of the bands may be approximately between 1 cm and 30 cm. In further examples, the width may be approximately between 3 cm and 20 cm. In still further examples, the width may be approximately between 5 cm and 15 cm. A length of the bands may be approximately between 1 cm and 45 cm. In some examples, the length may be approximately between 10 cm and 45 cm. In further examples, the length may be approximately between 15 cm and 30 cm. It has been found that these values provide for a large variety of elastic materials and a reasonable compromise between size and stability of the corresponding pouches. Again, the term "approximately" is to encompass typical product deviations. Narrower bands take up less space than wider bands, and they allow for holding small items. Wider bands, on the other hand, require more space than narrower bands, but they provide more retaining force to hold large items. With regard to narrower bands, for a particular available area, more narrow bands than wider bands may be provided. Thereby, a larger number of items can stably be held.

In some embodiments, a length of the holding structure is approximately between 5 cm and 45 cm. In further examples, the length is approximately between 10 cm to 30 cm. A height of the holding structure is approximately between 5 cm and 30 cm. In further examples, the height is approximately between 10 cm and 30 cm. Small holding structures take up less space, and they are provided for securely holding smaller items. Larger holding structures are provided to hold large and heavy items.

Further aspects of the holding structure are defined in further dependent claims.

Further aspects of the present disclosure relate to a bag, which may comprise a holding structure as described herein.

Such an arrangement on a bag provides a multitude of options to store and attach items to the bag, which may not fit into the main compartment(s) of the bag or which are kept on the outside, such as a pair of dirty shoes. The holding structure allows for reliably transporting such items with the bag due to their special arrangement of the bands, which define an angle greater than 0° and less than 90° with partial overlap. Such a bag may be provided as a backpack, wherein the holding structure may be arranged at a rear side of the backpack. An arrangement of the described holding structure on the rear side of the backpack allows for attaching even bulky items without compromising the comfort when carrying the backpack.

Alternatively, bags other than backpacks may be provided comprising the holding structure. This may include, but is not limited to, duffle bags, suitcases, purses or any other carrying bag.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

In the following, embodiments of the present invention are described with references to a backpack and a duffel bag. However, the person skilled in the art will readily recognize that the various features described below are equally applicable to other transport items such as other types of bags. Moreover, the described holding structure could also be integrated or attached to a piece of apparel, for example a jacket, to facilitate the carrying of a number or items within and/or on the outside of the jacket.

Further, it is to be noted that the features described below do not have to be used in combination but may also be combined differently wherein individual features may also be omitted. In order to avoid redundancies, reference is particularly made to the more general explanations in the previous section, which remain generally applicable also to the following detailed description of certain embodiments.

FIG. 1 shows a holding structure 100 arranged on a rear side of a backpack 101 according to certain embodiments.

The backpack 101 comprises a panel 102 forming a rear side of the backpack 101 on which two overlapping bands 110, 111 are arranged. The backpack 101 further comprises a bottom section 103 arranged at the lower end of the backpack 101. On a top of the backpack 101 an opening 104 is arranged in order to provide a possibility to insert items into at least one compartment (not shown) of the backpack 101. The opening 104 may be equipped with a zipper to close this compartment of the backpack 101. Further, the backpack 101 is equipped with two side pouches 105 on the left lateral side and on the right lateral side. On a front side of the backpack 101, shoulder straps may be arranged (not shown).

In certain embodiments of FIG. 1, the bands 110, 111 are arranged on the rear side, as already explained above. A first band 110 is centered on the panel 102 of the backpack 101. Further, the first band 110 may extend with a symmetric shape from the left lateral side to the right lateral side of the backpack 101. In other words, the width of the band 110 remains constant from left to right. The first band 110 is stitched at the left and right lateral edges to the panel 102 at the rear side of the backpack 101. Alternatively, the band 110 may be glued or otherwise attached to the panel 102 of the backpack 101 at the left and right lateral edges.

A second band 111 extends from the right lateral side in the direction of the left lateral side of the backpack 101, wherein the second band 111 extends partly underneath the first band 110. The second band 111 is arranged such that it is non-parallel to the first band 110. An intersecting angle between the two partly overlapping bands 110 and 111 is approximately 30 degrees. In some examples, the angle may be approximately 10 degrees to 80 degrees or it may be 50 degrees.

According to certain embodiments of FIG. 1, the second band 111 is arranged such that the topmost point of the second band 111 on the right lateral side is essentially aligned with the topmost point of the first band 110 on the left lateral side, i.e., the topmost points of the first band 110 and the second band 111 lie on a virtual, essentially horizontal line extending over the rear side of the backpack. Similarly, the lowermost point of the second band 111 on the right lateral side is essentially aligned with the lowermost point of the first band 110 on the left lateral side. Further, a right lateral edge of the second band 111 is aligned with the right lateral edge of the first band 110, i.e., the right lateral edge of the second band 111 does not extend farther to the right than the right lateral edge of the first band 110.

As may be readily seen in FIG. 1, the partially overlapping first and second bands 110 and 111 provide two partially superimposed holding regions. A first holding region is provided between the first band 110 and the second band 111, and a second holding region is provided between the second band 111 and the panel 102 of the backpack 101. Overall, two partially superimposed holding regions are provided on the panel 102 on the rear side of the backpack 101, one holding region partly behind the other, while only requiring a minimum area on the rear side of the backpack 101.

In some embodiments of FIG. 1, the second band 111 is arranged at a distance relative to the first band 110, wherein the distance may be measured as a gap between the topmost point of the first band 110 on the right lateral side and the lowest point of the second band 111 at the right lateral side. The distance is approximately 5 cm. In some examples, the distance may be approximately between 1 cm and 15 cm. In further examples, the distance may be approximately between 1 cm and 10 cm. In still further examples, the distance may be approximately between 2 cm and 5 cm.

In certain embodiments, a lowest point of the second band 111 on the right lateral side may abut the topmost point of the first band 110 on the right lateral side. Alternatively, the lowest point of the second band 111 on the right lateral side may be overlapped by the topmost point of the first band 110 on the right lateral side. The second band 111 may then extend from the right lateral side to the left lateral side and underneath the first band 110, while the width of the second band 111 may not change. The width of the first and the second band may be given as the distance between the lowest and the topmost points of the first and respectively the second band, e.g., on the right lateral side.

In some embodiments according to FIG. 1, the bands comprise elastane. In alternative embodiments, the bands may also comprise rubber, polyurethane, or other materials that provide some elasticity for the bands.

Figure 2:
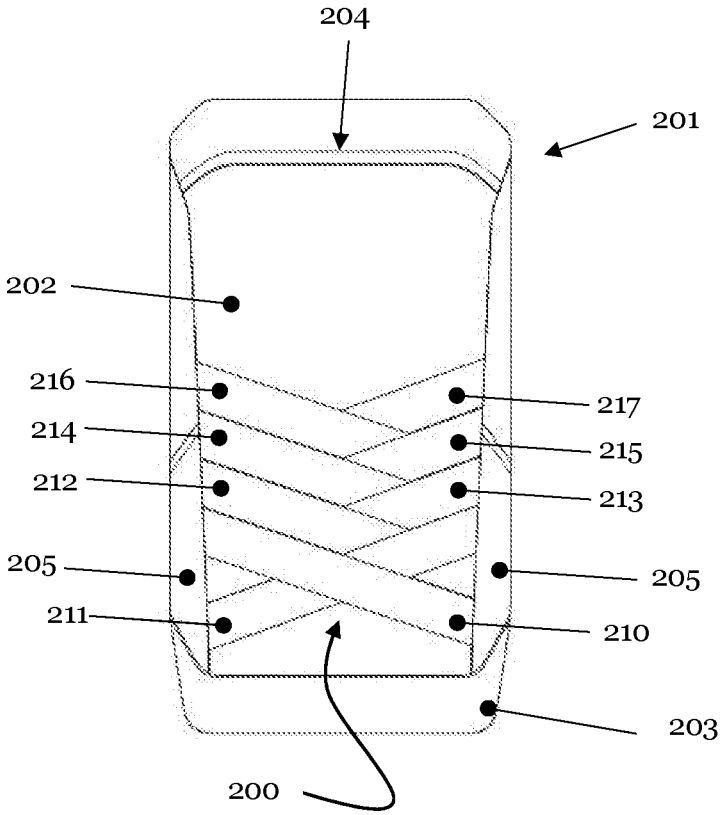
FIG. 2 is a front view of a holding structure comprising a plurality of pairwise bands arranged on a rear side of a backpack according to certain embodiments of the present invention.

FIG. 2 shows certain embodiments of a holding structure 200 arranged on a rear side of a backpack 201. Similar to backpack 101, the backpack 201 may include a bottom section 203, an opening 204, and two side pouches 205. In some embodiments of FIG. 2, a plurality of bands 210-217 are arranged on the panel 202 of the backpack 201. In addition to the overlapping bands 210 and 211 which are located at a lower end of the panel 202 of the backpack 201, essentially pairwise parallel bands 212-217 are arranged. The pair of a third and a fourth band 212 and 213 may be arranged such that a bottom edge of the third band 212, which extends from the left lateral side to the right lateral side, is essentially aligned with a topmost edge of the first band 210. Further, the third band 212 extends over the fourth band 213 but underneath the second band 211. For the fourth band 213, which extends from the right lateral side to the left lateral side, a bottom edge of the fourth band 213 is aligned with a topmost edge of the second band 211. Further, the fourth band 213 extends over a fifth band 214 and underneath the third band 212 and underneath the first band 210. Additionally, the lateral edges of the third and the fourth bands 212 and 213 may be aligned on the right and on the left lateral edges along a line formed by the lateral edges of the first and the second bands 210 and 211.

The further pairwise parallel bands 214-217 are aligned in a similar manner as the bands 210-213. The pair of bands 214 and 215 is aligned essentially parallel to the pair of bands 212 and 213 as well as to bands 210 and 211. The pair of bands 216 and 217 is aligned essentially parallel to the pair of bands 214 and 215 as well as to bands 212, 213 and 210, 211. Due to the pairwise parallel arrangement of the bands 210-217, an extremely stable webbing is formed, allowing for reliably attaching heavy items.

In some embodiments, any arbitrary number of bands may be provided, e.g., three, four, five, or any other number of bands.

In some examples, the third band 212 may be provided at a distance to the first band 210 and/or the second band 211, similarly as explained above with respect to the second band 111 of holding structure 100. Alternatively, the third band 212 may also overlap with the first band 210. Similar considerations also apply to any further band that may be applied.

While in some embodiments various design options of bands 212-217 other than the first and the second bands 210, 211 were discussed, the various design options as outlined with regard to the first and the second bands 110 and 111 according to the holding structure 100 of FIG. 1 may also apply to certain embodiments.

Figure 3:
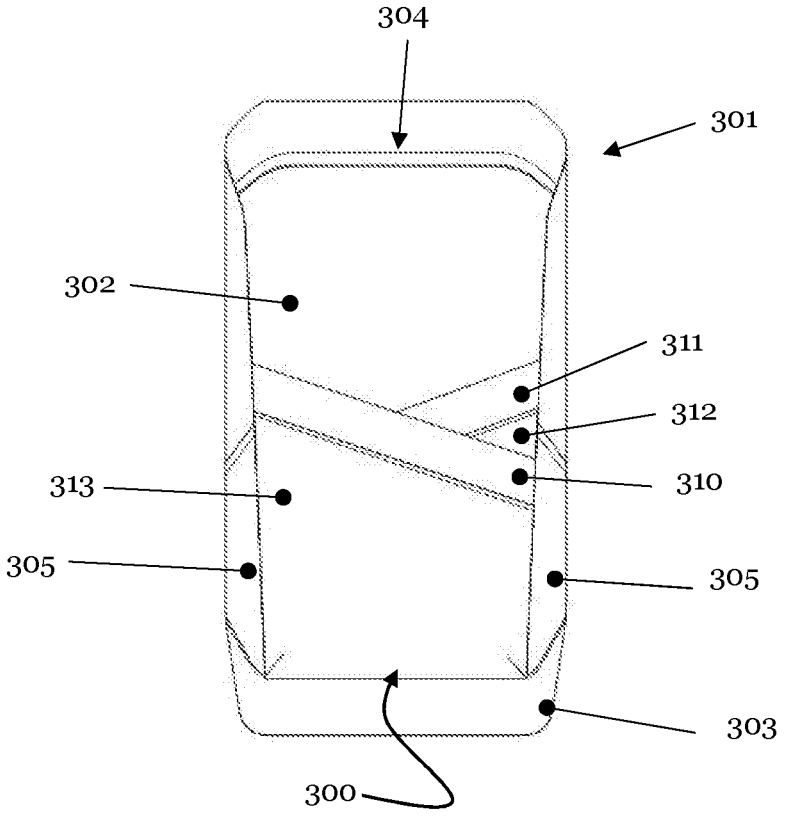
FIG. 3 is a front view of a holding structure comprising two overlapping bands with a liner connected to each band to form partially superimposed pouches arranged on a rear side of a backpack according to certain embodiments of the present invention.

FIG. 3 shows certain embodiments of a holding structure with two overlapping bands 310 and 311, wherein the two partially superimposed holding regions formed by the two bands 310, 311 are provided as two partially superimposed pouches.

The first and the second bands 310 and 311 are arranged on the panel 302 of the backpack 301, similar to the backpack 101 as described with respect FIG. 1. Similar to backpack 101, the backpack 301 may include an opening 304 and two side pouches 305. In contrast to some embodiments of FIG. 1, the bands 310 and 311 are each provided with a lining 312 and 313 in order to form pouches.

In the exemplary holding structure 300, the linings 312 and 313 are connected to a lower side of the bands 310 and 311. The linings may be stitched, glued, or otherwise be connected to the bands 310 and 311. They may be connected to a front or a back side of the band, wherein the back side is facing the panel 302 of the backpack 301. In some examples, the linings may be connected to different portions of the bands. For example, the lining may completely cover the bands 310, 311 or it may just partially cover the bands. Alternatively, a lining may only be connected to one of the bands 310, 311.

The linings 312, 313 are further connected to the panel 302 on the rear side of the backpack 301 at lateral edges and at a bottom edge of the lining. Thereby, the linings 312, 313 connected to the bands 310, 311 form pouches, wherein one pouch is formed between the linings 312 and 313 and another pouch is formed between the lining 312 and the panel 302 of the backpack. In certain embodiments, the lateral edges of the linings 312 and 313 are aligned with the lateral edges of the bands 310 and 311 similarly as described above with respect to the various bands. Also, the bottom edge of the linings 312, 313 are aligned. In some embodiments, the bottom edges of the linings are aligned with the bottom section 303 of the backpack 301. In certain embodiments, the linings 312 and 313 may not be aligned at lateral and/or bottom edges to form a plurality of pouches. The linings 312 and 313 may be provided such that the formed pouches have different sizes or that they have essentially the same size.

Additionally or alternatively to the above, one or both bands 310, 311 may be sealed at the bottom edges, e.g. by stitching, gluing or otherwise connecting the bottom edge to the panel 302 of the backpack, in order to provide pouches. In some examples, the band 311 may be aligned with and connected to the bottom edge of the first band 310. Thereby, a plurality of pouches can also be provided with essentially the same size or varying sizes.

While in certain embodiments various design options were discussed with regard to providing pouches, the various design options as outlined with regard to the first and the second bands 110 and 111 according to the holding structure 100 of FIG. 1 also apply in certain embodiments. Also, the discussions provided with respect to bands 210-217 of the holding structure 200 of FIG. 2 also apply to certain embodiments.

Figure 4A:
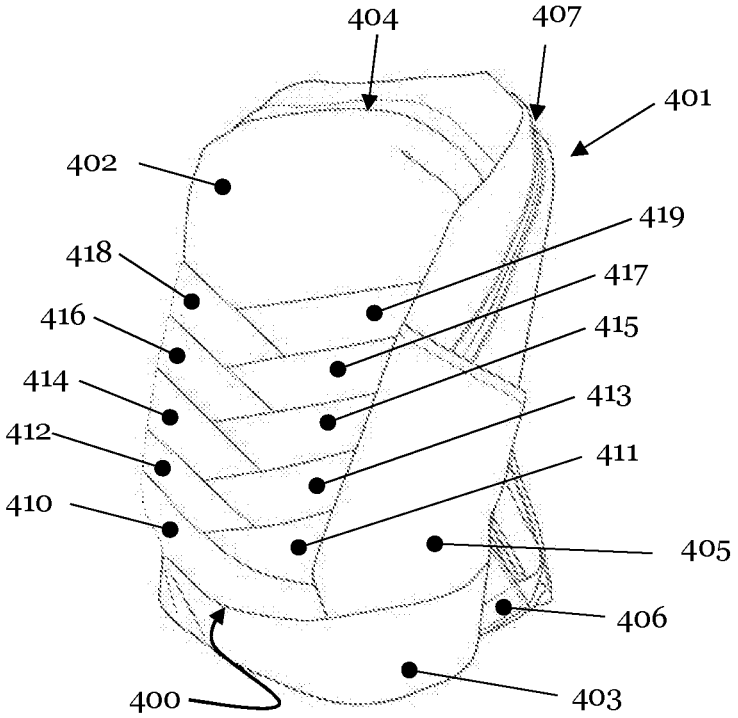
FIG. 4*a* is a rear perspective view of a backpack with a holding structure comprising a plurality of pairwise bands arranged on a rear side of the backpack according to certain embodiments of the present invention.
Figure 4B:
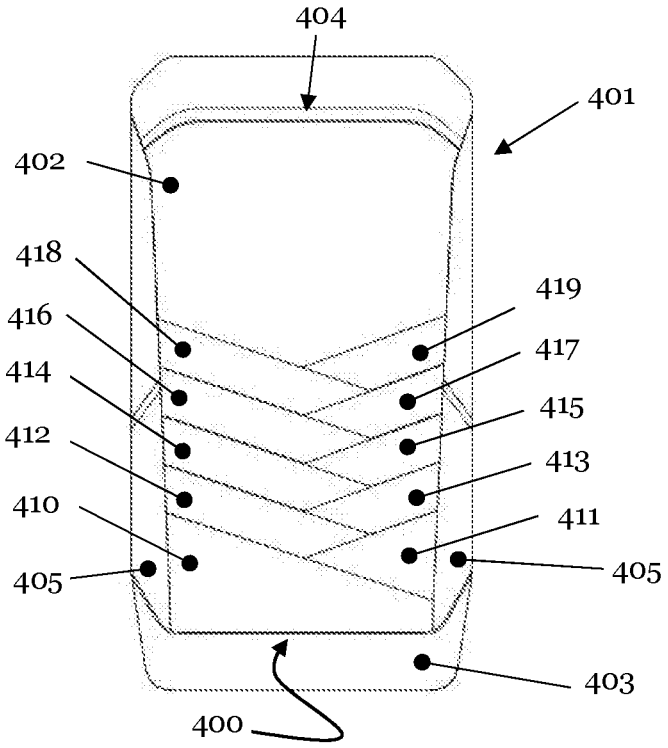
FIG. 4*b* is a rear view of the backpack according to FIG. 4*a*.

FIGS. 4*a* and 4*b* show certain embodiments of the holding structure 400 on the panel 402 of the backpack 401. FIG. 4*a* is a three-dimensional view of the backpack 401, and FIG. 4*b* shows a two-dimensional view of the holding structure 400 arranged on the rear side of the backpack 401. Similar to backpack 101, the backpack 401 may include an opening 404, two side pouches 405, and a shoulder strap 406. As may be seen from FIG. 4*a*, the backpack comprises a further opening 407 equipped with a zipper. Thereby, a possibility is provided to insert items into at least one main compartment (not shown) of the backpack 401.

A first band 410 is aligned with a topmost edge of the bottom section 403. Further, the first band 410 may extend with an asymmetric shape from the left lateral side to the right lateral side of the backpack 401. In other words, the width of the band 410 decreases from left to right. The first band 410 is stitched at the left and right lateral edges and at a bottom edge to the panel 402 at the rear side of the backpack 401. Alternatively, the band 410 may be glued or otherwise be attached to the panel 402 of the backpack 401 at the left and right lateral edges and the bottom edge. In particular, by stitching, gluing or otherwise attaching the bottom edge of the band 410 to the panel 402, the first band is sealed along the bottom edge in addition to the lateral edges, and thereby a first pouch is formed.

A second band 411 extends from the right lateral side in the direction of the left lateral side of the backpack 401, wherein the second band 411 extends partly underneath the first band 410. The second band 411 is arranged such that it is non-parallel to the first band 410. An intersecting angle between the two partly overlapping bands 410 and 411 may be approximately 10 degrees to 80 degrees. In some examples, the angle may approximately be 50 degrees.

According to certain embodiments of FIGS. 4*a* and 4*b*, the second band 411 is arranged such that the topmost point of the second band 411 on the right lateral side is essentially aligned with the topmost point of the first band 410 on the left lateral side, i.e., the topmost points of the first band 410 and the second band 411 lie on a virtual, essentially horizontal line extending over the rear side of the backpack. Further, a right lateral edge of the second band 411 is aligned with the right lateral edge of the first band 410, i.e., the right lateral edge of the second band 411 does not extend farther to the right than the right lateral edge of the first band 410. In some examples, a bottom edge of the second band 411 may be aligned with the bottom edge of the first band 410 (not shown in FIG. 4*a* or 4*b*), and a left edge of the second band 411 may be aligned with the left lateral edge of the first band 410 (not shown). Similarly as for the first band 410, the second band 411 may be connected to the panel 402 of the backpack 401 at its lateral edges and the bottom edge to form another pouch.

Alternatively, the bottom edge of the second band 411 may not be aligned with the bottom edge of the first band 410. In this case the bottom edge of the second band 411 may be upwardly displaced relative to the bottom edge of the first band 410. Further, also the topmost points of the first band 410 and the second band 411 may not lie on an essentially horizontal line, and/or the right and left lateral edges may not be aligned.

As may be readily seen in FIGS. 4*a* and 4*b*, the partially overlapping first and second bands 410 and 411 provide two partially superimposed holding regions similarly as bands 110 and 111 in FIG. 1.

In some embodiments, a lowest point of the second band 411 on the right lateral side may abut the topmost point of the first band 410 on the right lateral side. The second band 411 may then extend from the right lateral side to the left lateral side and underneath the first band 410, while the width of the second band 411 may not change. For certain embodiments, the width of the second band may be given as the distance between the lowest and the topmost points of the second band 411 on the right lateral side.

In some embodiments, the second band 411 may be arranged at a distance relative to the first band 410, similarly as explained with respect to band 111 in FIG. 1.

According to some embodiments in FIGS. 4*a* and 4*b*, similar to the first band 410 and the second band 411, essentially pairwise parallel bands 412-419 are arranged, similarly to bands 212-217 described in reference to FIG. 2. Therefore, in order to avoid redundancies, these explanations are not repeated here.

In certain embodiments according to FIGS. 4*a* and 4*b*, the first band 410 may be wider than each of the other bands 411-419. In some examples, the width of the first band may even be greater than the sum of two or more, or even all other bands 411-419. The first band 410 is provided as a base band which provides a stable base by means of a pouch of the holding structure 400. Additionally or alternatively, the same considerations may apply to the second band 411. In some examples, the first band may not be attached to the panel at the bottom edge to be provided as a base band. In some examples, at least one of the bands may be provided with zippers, knobs, Velcro fasteners, or other closing mechanisms.

In some embodiments, any arbitrary number of bands may be provided, e.g., three, four, five, or any other number of bands.

Similarly as already outlined above with respect to some embodiments according to FIG. 3, a lining may be stitched, glued, or otherwise be attached to at least one of the bands 410-419 (not shown in FIG. 4*a* or 4*b*). In some examples, the lining may be connected to the third band 412 on a side which is facing the panel 402 on the rear side of the backpack 401. The lining may completely cover the band 412 on the side facing the panel 402 of the backpack 401 or it may just partially cover the band. The lining may further be connected to the panel 402 on the rear side of the backpack 401 at lateral edges and at a bottom edge of the lining. Thereby, the lining connected to the band 412 forms another pouch, wherein the pouch is formed between the lining and the panel 402 of the backpack. In some examples, the lateral edges of the lining may be aligned with the lateral edges of the bands 410 and 411 similarly as described above with respect to the various bands. Also, the bottom edge of the lining may be aligned with bottom edges of at least one of the bands 410 and 411. In certain embodiments, a lining may be connected to any other band 411-419 or a lining may be connected at each band to form a plurality of pouches. In some examples, the lining may be connected to at least one or even all bands which are arranged essentially in parallel, e.g. bands 410, 412, 414, 416, and 418 or bands 411, 413, 415, and 417. The lining may further be provided such that the formed pouches have essentially the same size. The lining may also be provided such that the formed pouches have different sizes. In some examples, the lining connected to at least one or all bands which are, e.g., arranged in parallel, may all be connected to the bottom edge of the first band 410. Thereby, the sizes of the pouches decrease from the topmost band which forms with the lining a pouch to the pouch provided by the first band 410.

Additionally or alternatively to the above, at least one of the further bands 411-419 may be sealed at the bottom edges, e.g. by stitching, gluing or otherwise connecting the bottom edge to the panel 402 of the backpack, in order to provide pouches. In some examples, at least one of the bands 411-419 may be aligned with and connected to the bottom edge of the first band 410. Thereby, a plurality of pouches may be provided with varying sizes. In some examples, at least one or even all bands which are arranged essentially in parallel, e.g. bands 410, 412, 414, 416, and 418 or bands 411, 413, 415, and 417, may be aligned with and connected to the bottom edge of the first band 410 such that the sizes of the provided pouches decrease from the topmost band to the first band 410. In some examples, the bottom edge of at least one or even all bands which are arranged essentially in parallel may be upwardly displaced, e.g. the bottom edge of band 412 may upwardly displaced relative to the bottom edge of band 410, the bottom edge of band 414 may be upwardly displaced relative to the bottom edge of band 412, and so on, such that pouches of essentially similar sizes are provided.

In some embodiments, a reinforcing layer may also be provided. The reinforcing layer may be arranged between the panel 402 of the backpack and the bands 410-419. The reinforcing layer may comprise foam. In some examples, the reinforcing layer may comprise board.

As may be clearly derived from FIGS. 4*a* and 4*b*, a larger number of partially superimposed holding regions is provided in the described embodiments using only slightly more than half of the available space on the rear side of the backpack. Due to the described partial overlap, the bands 410-419 are supporting each other against elongation which assures a reliable storage of items in the described holding regions. The risk that any of the possibly large number of items stored in the various holding regions slips out of any of the holding regions is therefore minimized.

While in some embodiments a different shape of the first and the second bands 410, 411 is shown, the various design options as outlined with regard to the first and the second bands 110 and 111 according to the holding structure 100 described in reference to FIG. 1 also apply to certain embodiments. Also, the various design options regarding the bands 210-217 and discussed with regard to the holding structure 200 described in reference to FIG. 2 also apply to certain embodiments. Additionally, the design options of providing pouches as discussed with regard to certain embodiments in FIG. 3 apply to the other embodiments.

Figure 5:
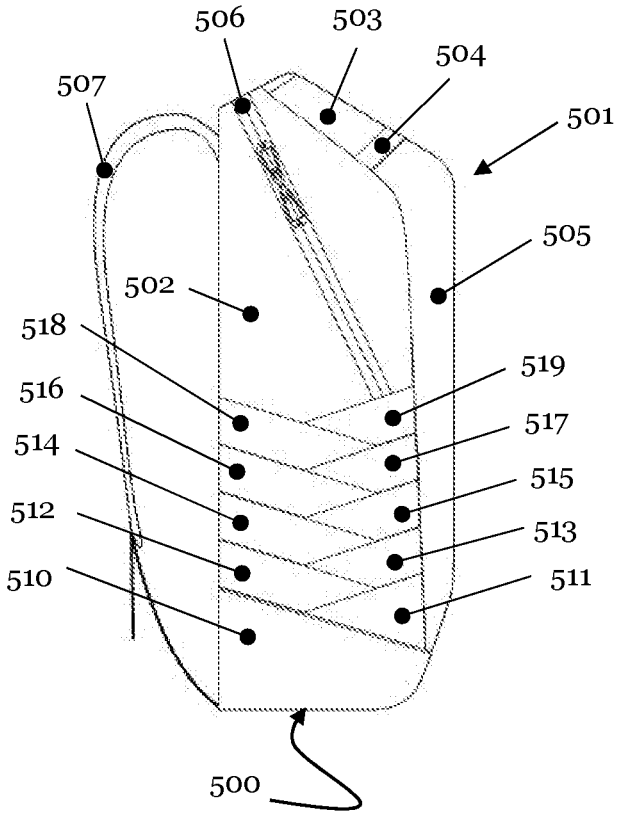
FIG. 5 is a side view of a holding structure comprising a plurality of pairwise bands arranged on a right lateral side of a backpack according to certain embodiments of the present invention.

In certain embodiments of FIG. 5, a holding structure 500 is arranged on a panel 502 located on a right lateral side of a backpack 501.

The backpack 501 comprises a panel 502 forming a right lateral side of the backpack 501 on which bands 510-519 are arranged. The backpack 501 further comprises top sections 503 and 504 arranged at the upper side of the backpack 501. The backpack 501 also comprises a rear section 505 and a front section at which a shoulder strap 507 is arranged. Further, the backpack 501 is equipped with a zipper 506 extending from a top of the backpack 501 to the lateral side(s). Thereby, a main compartment may be opened and closed.

At the panel 502 at the right lateral side of the backpack 501, a holding structure 500 is provided comprising elastic bands 510-519 which are arranged similarly to the bands 410-419 as described with respect to FIGS. 4*a* and 4*b*. Therefore, the same explanations as provided with regard to the holding structure 400 also apply to the holding structure 500, and they are not repeated here in order to avoid redundancies.

Additionally or alternatively, the holding structure 500 may be arranged on any other side, e.g. a left lateral side of the backpack 501, and/or the holding structure 500 may be arranged on the bottom side of the backpack 501, and/or the holding structure 500 may be arranged inside the backpack 501. Arranging the holding structure 500, however, on the rear side as shown in FIGS. 4*a* and 4*b* provides the greatest space for additional items to be arranged within the holding regions provided by the holding structure 500.

While in some embodiments various design options were discussed with regard to providing the holding structure 500 on a lateral side of the backpack, the various design options as outlined with regard to the holding structure 400 described with respect to FIGS. 4*a* and 4*b* also apply to certain embodiments. In contrast to the holding structure 400, the present holding structure 500 only differs with respect to its size, which is adapted such that the holding structure 500 fits on a lateral side of the backpack.

Figure 6A:
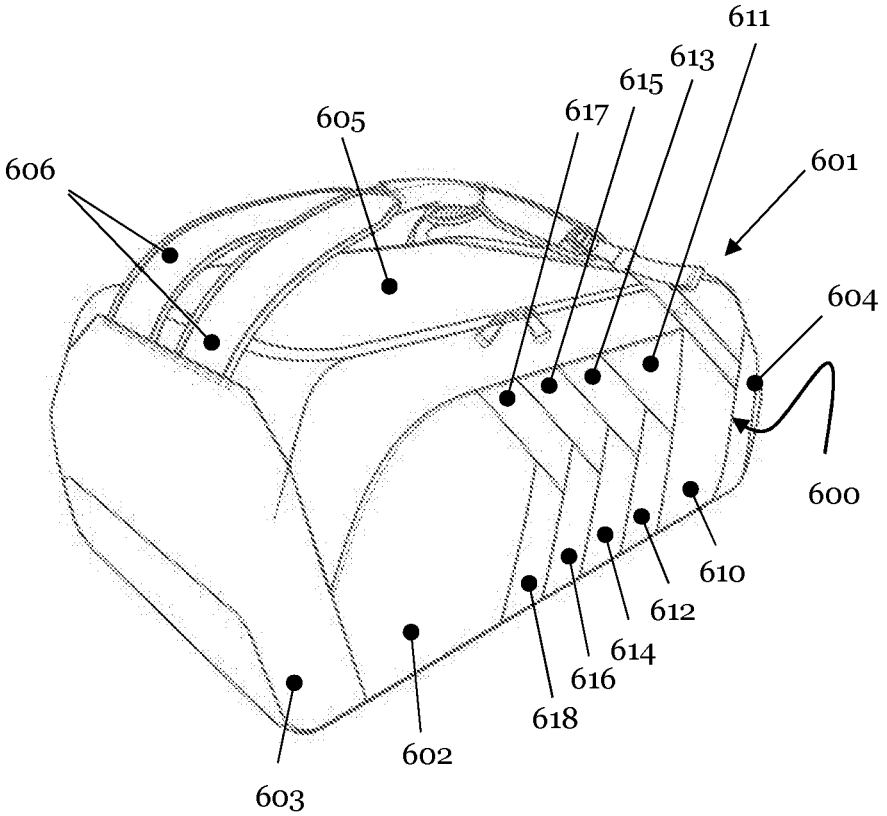
FIG. 6*a* is a side perspective view of a duffel bag with a holding structure comprising a plurality of pairwise bands arranged on a left lateral side of the duffel bag according to certain embodiments of the present invention.
Figure 6B:
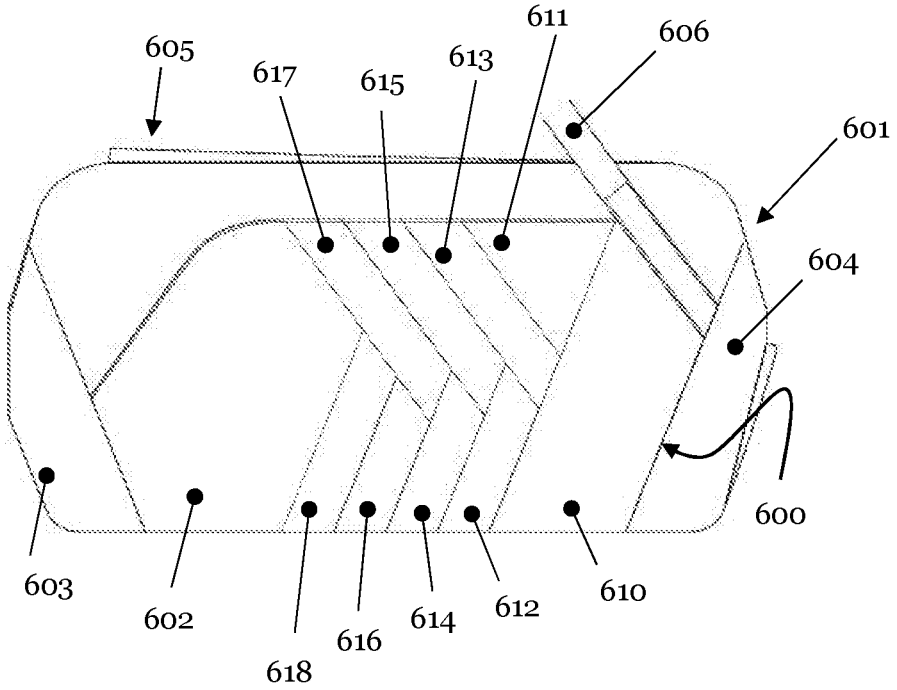
FIG. 6*b* is a side view of the left lateral side of the duffel bag according to FIG. 6*a*.

In certain embodiments of FIGS. 6*a* and 6*b*, a holding structure 600 is arranged at a left lateral side of a duffel bag 601.

The duffel bag 601 comprises a panel 602 forming a left lateral side of the duffel bag 601 on which bands 610-618 are arranged. The duffel bag 601 further comprises front and rear sections 603 and 604. Further, at a top section 605 of the duffel bag 601, a zipper is arranged in order to provide a possibility to insert items into at least one main compartment (not shown) of the duffel bag 601. Also at the top section 605, hand straps 606 are arranged, which extend from the front section 603 to the rear section 604. The hand straps 606 are provided such that they possibly also serve as shoulder straps for carrying the duffel bag 601 similar as a backpack.

At the panel 602 at the left lateral side of the duffel bag 601, a holding structure 600 is provided comprising elastic bands 610-618 which are arranged similarly to the bands 410-419 or 510-519 according to the embodiments described in reference to FIG. 4*a*, FIG. 4*b* and FIG. 5. Therefore, the same explanations as provided with regard to the holding structure 400 and the holding structure 500 also applies to the holding structure 600. They are not repeated here in order to avoid redundancies.

Similarly as explained with respect to the backpack, additionally or alternatively, the holding structure 600 may be arranged on any other side, e.g. a right lateral side of the duffel bag 601, and/or it may be arranged on the bottom side of the duffel bag 601, and or it may be arranged on the front and/or the rear side of the duffel bag 601, and/or it may be arranged inside the duffel bag 601. Arranging the holding structure 600, however, on the right and/or the left lateral side as shown in FIGS. 6*a* and 6*b* provides the greatest space for additional items to be arranged within the holding regions provided by the holding structure.

While in certain embodiments various design options were discussed with regard to providing the holding structure 600 on a duffel bag 601, the various design options as outlined with regard to the holding structures 400 and 500 also apply to certain embodiments. In contrast to the holding structures 400 and 500, the present holding structure 600 only differs with respect to its size, which is adapted such that the holding structure 600 fits on a side of the duffel bag 601.

In the following, further examples are described to facilitate the understanding of the invention:

Example 1

A holding structure for a bag, the holding structure comprising:

a. a first band and a second band arranged on a panel of the bag, each of the first band and the second band comprising an elastic material;

b. wherein the first band and the second band define an angle greater than 0° and less than 90° with a partial overlap so that two at least partially superimposed holding regions are formed.

Example 2

The holding structure according to Example 1, including a third band comprising an elastic material arranged on the panel of the bag, wherein the third band overlaps at least partially with at least one of the first band and the second band so that a third holding region is formed, and wherein the third band is parallel to the first band.

Example 3

The holding structure of Example 2, including a fourth band comprising an elastic material arranged on the panel of the bag, wherein the first band is parallel to the third band, and the second band is parallel to the fourth band.

Example 4

The holding structure of Example 3, comprising more than four overlapping bands.

Example 5

The holding structure of any of the preceding Examples, comprising at least four bands, wherein the second band extends over the third band and below the first band, and wherein the third band extends over the fourth band and below the second band.

Example 6

The holding structure of any of the preceding Examples, wherein at least one of the holding regions is provided as a pouch.

Example 7

The holding structure of any of the preceding Examples, wherein an outermost band of the holding structure is sealed along one outermost edge to form a pouch.

Example 8

The holding structure of any of the preceding Examples, wherein a lining is arranged between at least one band and the panel of the bag to form a pouch.

Example 9

The holding structure of Example 7, wherein the sealed outermost band is a base band, wherein the base band is wider than the one or more other bands of the holding structure.

Example 10

The holding structure of Examples 3 to 9, wherein one or more bands which are arranged in parallel on the panel of the bag each comprise a lining arranged between each band and the panel of the bag to form one or more pouches.

Example 11

The holding structure of any of Examples 3 to 10, wherein one or more bands which are arranged in parallel on the panel of the bag are each sealed along a same side such as to form one or more pouches.

Example 12

The holding structure of any of Examples 3 to 11, wherein one or more bands which are arranged in parallel on the panel of the bag each comprise a lining arranged thereon, wherein each lining extends to a base band such as to form one or more pouches of different size.

Example 13

The holding structure of any of the preceding Examples, further comprising a reinforcing layer arranged on the bag, wherein the reinforcing layer is arranged between the panel and the bands.

Example 14

The holding structure of any of the preceding Examples, wherein a width of the bands is between 1 cm and 30 cm, preferably between 3 cm and 20 cm, more preferably between 5 cm and 15 cm.

Example 15

The holding structure of any of the preceding Examples, wherein a length of the bands is between 1 cm and 45 cm, preferably between 10 cm and 45 cm, more preferably between 15 cm and 30 cm.

Example 16

The holding structure of any of the preceding Examples, wherein a length of the holding structure is between 5 cm and 45 cm, preferably between 10 cm to 30 cm, and wherein a height of the holding structure is between 5 cm and 30 cm, preferably between 10 cm and 30 cm.

Example 17

The holding structure of any of the preceding Examples, wherein the bands extend essentially from one lateral edge of the panel of the bag to the other lateral edge of the panel of the bag.

Example 18

The holding structure of any of the preceding Examples, wherein the holding structure is arranged on an outside of the bag.

Example 19

A bag comprising a holding structure according to any of Examples 1-18.

Example 20

The bag according to Example 19, wherein the bag is provided as a backpack and wherein the holding structure is arranged at a rear side of the backpack.

Different arrangements of the components depicted in the drawings or described above, as well as components and steps not shown or described are possible. Similarly, some features and sub-combinations are useful and may be employed without reference to other features and sub-combinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications may be made without departing from the scope of the claims below.

That which is claimed is:

1. A holding structure for a bag, the holding structure comprising:

a first band and a second band arranged on a panel of the bag, each of the first band and the second band comprising an elastic material;

wherein the first band and the second band define an angle greater than 0° and less than 90° with a partial overlap of the first band and the second band so that at least two partially superimposed holding regions are formed;

wherein an outermost band of the holding structure is sealed along one outermost edge to form a pouch;

wherein the outermost band is a base band; and wherein the base band is wider than at least one other band of the holding structure.

2. The holding structure according to claim 1, further comprising a third band arranged on the panel of the bag and comprising the elastic material, wherein the third band overlaps at least partially with at least one of the first band or the second band so that a third holding region is formed, and wherein the third band is parallel to the first band.

3. The holding structure of claim 2, further comprising a fourth band arranged on the panel of the bag and comprising the elastic material, wherein the first band is parallel to the third band, and the second band is parallel to the fourth band.

4. The holding structure of claim 3, further comprising more than four overlapping bands.

5. The holding structure of claim 3, comprising at least four bands, wherein the second band extends over the third band and below the first band, and wherein the third band extends over the fourth band and below the second band.

6. The holding structure of claim 1, wherein at least one holding region forms at least a portion of the pouch.

7. The holding structure of claim 1, wherein a lining is arranged between at least one band and the panel of the bag to form the pouch.

8. The holding structure of claim 3, wherein at least one band which is arranged in parallel on the panel of the bag comprises a lining arranged between the at least one band and the panel of the bag to form at least one pouch.

9. The holding structure of claim 3, wherein at least one band which is arranged in parallel on the panel of the bag is sealed along a same side such as to form at least one pouch.

10. The holding structure of claim 3, wherein at least one band which is arranged in parallel on the panel of the bag comprises a lining arranged thereon, wherein the lining extends to the base band such as to form at least one pouch of a different size.

11. The holding structure of claim 1, further comprising a reinforcing layer arranged on the bag, wherein the reinforcing layer is arranged between the panel and at least one band.

12. The holding structure of claim 1, wherein a width of at least one band is between 1 cm and 30 cm.

13. The holding structure of claim 1, wherein a length of at least one band is between 1 cm and 45 cm.

14. The holding structure of claim 1, wherein a length of the holding structure is between 5 cm and 45 cm, and wherein a height of the holding structure is between 5 cm and 30 cm.

15. The holding structure of claim 1, wherein at least one band extends substantially from one lateral edge of the panel of the bag to the other lateral edge of the panel of the bag.

16. The holding structure of claim 1, wherein the holding structure is arranged on an outside of the bag.

17. The bag comprising the holding structure according to claim 1.

18. The bag according to claim 17, wherein the bag comprises a backpack and wherein the holding structure is arranged on a rear side of the backpack.

* * * * *